US007475880B2

(12) United States Patent
Bosik

(10) Patent No.: US 7,475,880 B2
(45) Date of Patent: Jan. 13, 2009

(54) BALLISTIC TARGET

(76) Inventor: Anthony Bosik, 6809 Lakes Park Dr., Greely, ON (CA) K4P 1P1

( * ) Notice: Subject to any disclaimer, the term of this patent is extended or adjusted under 35 U.S.C. 154(b) by 0 days.

(21) Appl. No.: 11/822,321

(22) Filed: Jul. 5, 2007

(65) Prior Publication Data

US 2008/0088091 A1 Apr. 17, 2008

(51) Int. Cl.
*F41J 1/12* (2006.01)

(52) U.S. Cl. ..... 273/403; 273/404

(58) Field of Classification Search ..... 273/403–410
See application file for complete search history.

(56) References Cited

U.S. PATENT DOCUMENTS

| | | | | | |
|---|---|---|---|---|---|
| 2,901,254 | A * | 8/1959 | Fortson | ..... | 273/404 |
| 4,066,261 | A * | 1/1978 | Stewart | ..... | 273/403 |
| 4,201,385 | A * | 5/1980 | Szabados | ..... | 273/410 |
| 4,239,236 | A * | 12/1980 | Parham et al. | ..... | 273/403 |
| 4,294,452 | A * | 10/1981 | Schlotter et al. | ..... | 273/403 |
| 4,317,572 | A * | 3/1982 | Iseli | ..... | 273/406 |
| 4,546,984 | A * | 10/1985 | Towle et al. | ..... | 273/404 |
| 4,773,653 | A * | 9/1988 | Unverzagt | ..... | 273/404 |
| 4,819,946 | A * | 4/1989 | Kahler | ..... | 273/404 |
| 4,821,620 | A * | 4/1989 | Cartee et al. | ..... | 89/36.02 |
| 4,856,791 | A * | 8/1989 | McQuade | ..... | 273/410 |
| 5,366,105 | A * | 11/1994 | Kerman et al. | ..... | 220/62.11 |
| 5,988,647 | A * | 11/1999 | Porter et al. | ..... | 273/410 |
| 6,009,790 | A * | 1/2000 | Tekorius | ..... | 89/36.02 |
| 6,068,261 | A * | 5/2000 | Nettle | ..... | 273/408 |
| 6,173,956 | B1 * | 1/2001 | O'Neal | ..... | 273/410 |
| 6,254,100 | B1 * | 7/2001 | Rinehart | ..... | 273/403 |
| 6,732,628 | B1 | 5/2004 | Coburn | | |
| 2004/0108659 | A1 * | 6/2004 | Pulkrabek | ..... | 273/404 |
| 2007/0290446 | A1 * | 12/2007 | Amick | ..... | 273/404 |

FOREIGN PATENT DOCUMENTS

DE 3212781 A1 * 10/1983

* cited by examiner

*Primary Examiner*—Mark S Graham
(74) *Attorney, Agent, or Firm*—Ronald G. Bitner

(57) ABSTRACT

A target suitable for target practice or receiving warning shots which includes a bullet stopping plate with a bullet trapping panel. The plate includes a side wall designed to confine bullets fired at an angle. The bullet trapping panel includes a cut-out region with bevelled edges for receiving a replaceable section in the high impact area of the target.

2 Claims, 1 Drawing Sheet

BALLISTIC TARGET

BACKGROUND OF THE INVENTION

1. Field of the Invention

This invention relates to a target for projectiles, and particularly to an improved target suitable for target practice or for receiving warning shots.

2. Description of the Prior Art

Various forms of targets for firearms are known, being used for target practice, or for receiving warning shots in correctional institutions, for example. One known type consists of a steel plate with a bullet trapping material on the front surface. The bullet trapping material comprises a rubber based material such as recycled tires.

The known types have been found not to be entirely satisfactory. One problem with the known type is that with extended use the high impact area, such as the region having the bull's eye or other target region, tends to deteriorate, limiting the useful life of the target. The bullet trapping panel, being bonded to the steel backing plate is not readily replaced, so that typically the entire targe must be replaced. Another deficiency of the existing targets of this type is that they do not reliably confine bullets fired at an angle, as they allow bullets to exit at the sides.

SUMMARY OF THE INVENTION

An object of the present invention is to provide an improved target that traps projectiles and provides extended use.

Another object of the present invention is to provide a target that traps and confines projectiles fired at an angle.

The present invention provides a target with a quick replaceable high impact target area, and a border that confines projectiles fired at an angle.

Specifically, the present target comprises; a plate for stopping fired projectiles; a panel of projectile trapping material attached to the plate; the backing plate having a side wall bordering the projectile trapping material for confining projectiles fired at an angle; said panel of projectile trapping material including a recess with bevelled edges for receiving a replaceable section of projectile trapping material; said replaceable section having bevelled edges that mates with the recess, and having a supporting plate for removably attaching to said backing plate.

DESCRIPTION OF THE PREFERRED EMBODIMENTS

Figure 1:
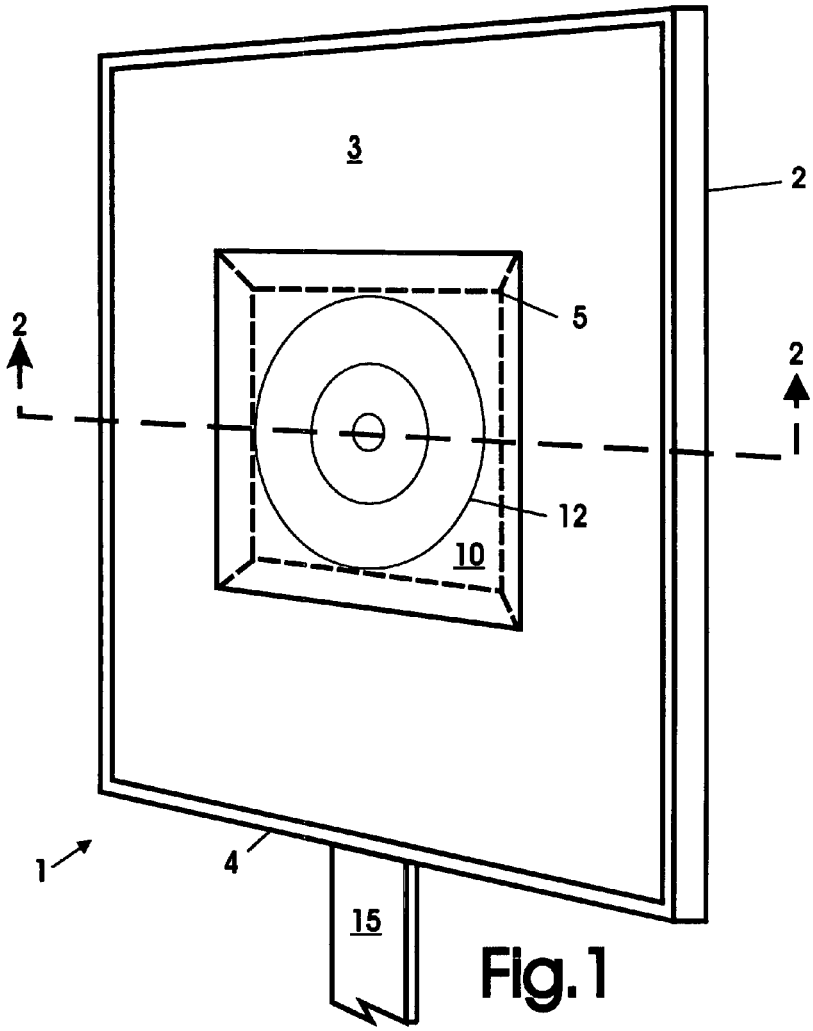
FIG. 1 is a perspective view of one embodiment of the target according to the present invention.
Figure 2:
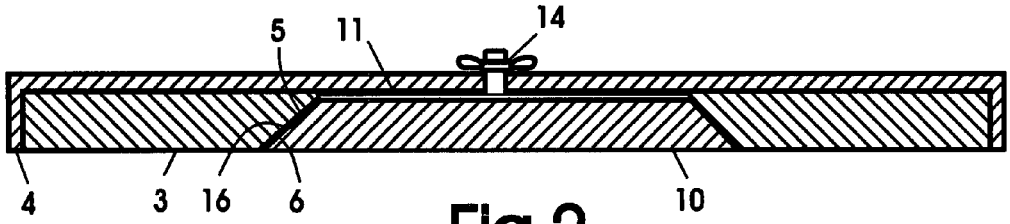
FIG. 2 is a sectional view taken at 2-2 of the target shown in FIG. 1.

With reference to FIGS. 1 and 2, the present invention comprises a target assembly 1 comprising a back plate 2 and a panel of bullet trapping material 3.

The material for the plate 2 will be selected to be suitable to prevent penetration of bullets or projectiles to be fired at the target. Typically the plate will be made of steel.

Bonded to the plate 2 is a panel of bullet trapping material 3. The bullet trapping material may consist of a dense rubber based material such as recycled tires, which may be in granular form bonded to form the panel. The bullet trapping material prevents ricochets and retains the bullets and lead particles.

Attached to the plate 2 and bordering the bullet trapping material is a side wall 4 designed to confine bullets fired at an angle.

The panel of bullet trapping material 3 includes a central recess or cut-out region 5 with bevelled edges 6, for receiving a replaceable section 10, which can be best seen in FIG. 2. The replaceable section 10 comprises bullet trapping material 13, which can be made of the same type of material used for the surrounding material 3. The replaceable section has bevelled edges 16 that mates with the recess 5. The edges of the trapping material 3 are bevelled to reduce the possibility of a bullet entering and fragments exiting along the space between the insert and main panel. The replaceable section 10 includes a supporting plate 11 for attaching with the backing plate 2 by suitable means, shown in the form of a bolt and wing nut 14. The target assembly 1 may be supported by a suitable stand or support means 15.

The use of a replaceable section significantly increases the life the target assembly. The replaceable section is easily removed and replaced reducing the costs of operation.

FIG. 1 shows the replaceable section 10 having an image 12 in the form of a bull's eye. It will be understood that such an image, or other desired target image, such as a silhouette, can be placed on the bullet trapping material, the replaceable section, or both.

A target assembly found to be suitable for 9 mm firearms included a backing member of hardened steel ¼ inch thick with dimensions 24 inches by 36 inches and included a border 1½ inches deep surrounding the bullet trapping panel. The bullet trapping panel was formed of a dense rubber 2 inches thick, formed of recycled rubber. The supporting panel for the replaceable section was a metal plate 1/16 inch thick, removably attached to the main plate by a bolt and wing nut. The replaceable panel had bevelled edges with an angle of about 45°.

For applications where fire is a concern, the bullet trapping panel may be provided with a fire retardant material or coating.

It will be understood that the configuration or other aspects of the target may vary, depending on the particular application, the firearm or ammunition used.

What is claimed is:

1. A ballistic target comprising;

a plate for stopping fired projectiles;

a panel of projectile trapping material attached to said plate;

said backing plate having a side wall bordering the projectile trapping material for confining projectiles fired at an angle;

said panel of projectile trapping material including a recess with bevelled edges receiving a replaceable section of projectile trapping material;

said replaceable section having bevelled edges that mates with said recess, and having a supporting plate for removably attaching to said backing plate.

2. The device of claim 1, wherein the projectile trapping material comprises a dense rubber based material bonded to the backing plate.

* * * * *